United States Patent [19]

Kataoka et al.

[11] Patent Number: 4,588,673

[45] Date of Patent: May 13, 1986

[54] RETOUCHABLE MAT FILM

[75] Inventors: Shinzi Kataoka; Yukio Shinagawa; Shinji Sakaguchi, all of Kanagawa, Japan

[73] Assignee: Fuji Photo Film Co., Ltd., Kanagawa, Japan

[21] Appl. No.: 704,903

[22] Filed: Feb. 22, 1985

Related U.S. Application Data

[63] Continuation of Ser. No. 509,078, Jun. 29, 1983, abandoned.

[30] Foreign Application Priority Data

Jun. 30, 1982 [JP] Japan ..... 57-114358

[51] Int. Cl.[4] ..... G03C 1/06; G03C 1/76

[52] U.S. Cl. ..... 430/264; 430/537; 430/535; 430/536; 430/517

[58] Field of Search ..... 430/537, 535, 536, 517, 430/264

[56] References Cited

U.S. PATENT DOCUMENTS

| | | | |
|---|---|---|---|
| T873,009 | 12/1969 | Campbell | 430/536 X |
| 2,327,828 | 3/1941 | Simmons | 430/513 |
| 2,400,989 | 3/1945 | Hart et al. | 430/536 |
| 3,021,214 | 3/1958 | Murphy, Jr. et al. | 430/536 X |
| 3,062,648 | 2/1960 | Crawford | 430/264 |
| 3,353,958 | 11/1967 | Moede | 430/535 |
| 3,440,049 | 4/1969 | Moede | 430/264 |

FOREIGN PATENT DOCUMENTS

| | | | |
|---|---|---|---|
| 2044943A | 10/1980 | United Kingdom | 430/264 |

OTHER PUBLICATIONS

J. Gasper and J. J. DePalma, "Optical Properties of the Photographic Emulsion", Chapter 20 of *The Theory of the Photographic Process* (4th Edition), Macmillan Publishing Co., Inc., New York, 1977, p. 579.

*Primary Examiner*—John E. Kittle
*Assistant Examiner*—Cynthia Hamilton
*Attorney, Agent, or Firm*—Sughrue, Mion, Zinn, Macpeak, and Seas

[57] ABSTRACT

A retouchable mat film comprising a hydrophobic support which has formed thereon a mat layer containing silicon dioxide as a matting agent is disclosed. The mat layer further includes a mixture of poly(methyl methacrylate) or a copolymer containing at least 80 wt % of methyl methacrylate and a hydrophilic polymer as a binder. This mat film withstands several retouching operations in ink.

5 Claims, No Drawings

RETOUCHABLE MAT FILM

This is a continuation of application Ser. No. 509,078, filed June 29, 1983 abandoned.

FIELD OF THE INVENTION

The present invention relates to a retouchable mat film and, more particularly, to a retouchable mat film which has a mat layer on either or both surfaces of a hydrophobic support and wherein letters can be written into or erased from the mat layer(s) or a wash-off relief image formed on said layer(s).

BACKGROUND OF THE INVENTION

Mat films consisting of an inflexible hydrophobic support and an overlying mat layer containing a matting agent such as silicon dioxide, titanium oxide or glass powder are directly used for drawing purposes or coated with a photosensitive emulsion layer to form a wash-off photographic material which is exposed in a selected image area, developed and has the non-image area subsequently washed off.

In order to be used for these purposes, mat films are especially required to have the following features:

(1) They have high tensile strength, tear strength and bending strength, no tendency of curling and are dimensionally stable against changes in temperature and humidity;

(2) letters can be easily written into the mat films in drawing ink or with a pencil and they can be easily erased from the mats;

(3) letters can be rewritten in the retouched area in drawing ink or with a pencil a number of times.

Various approaches to improve erasability of letters from mat films have been considered. For example, Japanese Patent Application (OPI) No. 53067/81 (corresponding to U.S. Pat. No. 4,366,239) (the term "OPI" as used herein refers to a "published unexamined Japanese patent application") discloses that such an improvement is achieved by incorporating poly(methyl methacrylate) and nitrocellulose in the mat layer as binders. Other conventional binders for the mat layer include vinylidene chloride copolymers (see, for example, British Pat. No. 1,047,697 (U.S. Pat. No. 3,370,951)); poly(methyl methacrylate) (see, for example, U.S. Pat. No. 3,353,958); polyesters or polyester amides (see, for example, U.S. Pat. No. 3,627,563); acetyl cellulose (see, for example, Japanese Patent Publication No. 48844/74 (U.S. Pat. No. 3,615,554)); and cellulose esters and polyesters (see, for example, Japanese Patent Publication No. 39414/74). After letters written in drawing ink on the mat layer containing these binders were erased with a rubber eraser, frequently, it was not possible to write lines of the desired fineness in the erased area because it repelled the drawing ink.

SUMMARY OF THE INVENTION

Therefore, the primary object of the present invention is to provide a mat layer that can be retouched in ink at least 10 times.

This object of the present invention can be achieved by a retouchable mat film that incorporates in the mat layer a binder made of a mixture of poly(methyl methacrylate) or a copolymer containing at least 80 wt % of methyl methacrylate and a hydrophilic polymer.

DETAILED DESCRIPTION OF THE INVENTION

Suitable methyl methacrylate copolymers are those copolymerized with vinyl compounds such as methyl acrylate, ethyl acrylate, butyl acrylate, styrene, methyl styrene, chlorostyrene, vinyl acetate, vinyl chloride, vinylidene chloride, acrylic acid, acrylonitrile, glycidyl acrylate, glycidyl methacrylate and hydroxyethyl acrylate.

Illustrative hydrophilic polymers are polymers and copolymers containing at least 5 mol %, preferably at least 10 mol %, of a vinyl compound having a carboxyl group such as acrylic acid or methacrylic acid; cellulose derivatives having a carboxyl group such as cellulose acetyl phthalate and cellulose acetyl hexahydrophthalate; cellulose ether; polymers and copolymers containing at least 10 mol % of a vinyl compound having a hydroxyl group such as vinyl alcohol, hydroxyalkyl (meth)acrylate (e.g., hydroxyethyl (meth)acrylate, 2-hydroxypropyl (meth)acrylate or diethylene glycol mono(meth)acrylate); as well as water-soluble natural polymers such as gelatin and starch. Polymers and copolymers of carboxyl group having vinyl compounds that are miscible with poly(methyl) methacrylate) and derivatives thereof are preferred. (Meth)acrylate means acrylate and methacrylate. Accordingly, for example, hydroxyalkyl (meth)acrylate means hydroxyalkyl acrylate and hydroxyalkyl methacrylate.

More specifically, preferred hydrophilic polymers include, but are by no means limited to, the following:

1. Methyl methacrylate-acrylic acid copolymer (83:17 mol %)
2. Methyl methacrylate-acrylic acid copolymer (88:12 mol %)
3. Methyl methacrylate-itaconic acid copolymer (90:10 mol %)
4. Methyl methacrylate-maleic acid copolymer (92:8 mol %)
5. Styrene-acrylic acid copolymer (85:15 mol %)
6. Methyl methacrylate-methacrylic acid copolymer (88:12 mol %)
7. Methyl methacrylate-methacrylic acid copolymer (85:15 mol %)
8. Ethyl methacrylate-methacrylic acid copolymer (86:14 mol %)
9. Ethyl methacrylate-methacrylic acid copolymer (83:17 mol %)
10. Butyl methacrylate-methacrylic acid copolymer (80:20 mol %)
11. Tert-butyl methacrylate-acrylic acid copolymer (84:16 mol %)
12. Propylmethacrylate-methacrylic acid copolymer (82:18 mol %)
13. Styrene-butyl acrylate-methacrylic acid copolymer (45:40:15 mol %)
14. Styrene-vinyl acetate-methacrylic acid copolymer (40:45:15 mol %)
15. Butyl methacrylate-2-hydroxyethyl methacrylate copolymer (30:70 mol %)
16. Butyl methacrylate-2-hydroxyethyl acrylate copolymer (40:60 mol %)
17. Butyl methacrylate-2-hydroxypropyl methacrylate copolymer (35:65 mol %)
18. Butyl methacrylate-diethylene glycol monomethacrylate copolymer (45:55 mol %)
19. Methyl methacrylate-2-hydroxyethyl methacrylate copolymer (42:58 mol %)

20. Methyl methacrylate-methacrylic acid-acrylic acid copolymer (84:8:8 mol %)
21. Methyl methacrylate-methacrylic acid-2-hydroxyethyl methacrylate copolymer (60:10:30 mol %)
22. Cellulose acetyl phthalate
23. Cellulose acetylhexahydrophthalate
24. Methyl cellulose
25. Ethyl cellulose
26. Hydroxyethyl cellulose
27. Hydroxypropyl cellulose
28. Methyl methacrylate-vinyl alcohol copolymer (75:25 mol %)
29. Ethylene-vinyl alcohol copolymer (70:30 mol %)
30. Vinyl acetate-vinyl alcohol copolymer (30:70 mol %)
31. Cyanoethyl cellulose The mixing ratio of polymethyl methacrylate or methyl methacrylate copolymer to the hydrophilic polymer is preferably such that the hydrophilic polymer content is 80 to 20 wt %, more preferably 70 to 30 wt %, of the total binder.

Preferred binder mixtures for use in the present invention include a mixture of poly(methyl methacrylate) and a hydrophilic polymer, more specifically, a mixture of poly(methyl methacrylate) and a methacrylic acid copolymer.

A suitable matting agent for use in the present invention is silicon dioxide which may be used in combination with titanium oxide, zinc oxide, starch or barium sulfate. Preferred silicon dioxide is "crystalline silica" and is commercially available from Tatsumori K.K., Japan under the trade name of Crystalite-FM-1 or -VXR. There is no particular limitation to the particle size of the matting agent, but the preferred average size is from 0.5 to 10$\mu$, and a 1 to 5$\mu$ range is particularly preferred.

Suitable hydrophobic supports for use in the present invention include polyester films such as polyethylene terephthalate and polyethylene naphthalate films; cellulose ester films such as cellulose acetate and cellulose acetate butyrate films; and polycarbonate films. Dimensionally stable polyester films, especially polyethylene terephthalate films, are used with particular advantage.

The hydrophobic support is coated with a mat layer formed from a dispersion of the binder and the matting agent in a suitable solvent that is prepared by agitation with an attritor, sand grinder, homomixer or a ball mill. Suitable solvents include ketones such as acetone, methyl ethyl ketone and cyclohexanone; esters such as ethyl acetate, propyl acetate and butyl acetate; ethers such as dioxane and tetrahydrofuran; alcohols such as methanol, ethanol, propanol, butanol and diacetone alcohol; chlorides such as methylene chloride, ethylene chloride and propylene chloride; phenols such as phenol, cresol and resorcin; methyl cellosolve, ethyl cellosolve, methyl cellosolve acetate and dimethylformamide. These solvents may be used either alone or in combination.

The mat layer may contain a coating aid, a cross-linking agent or a whitening agent without any resulting disadvantage. A preferred whitening agent is titanium oxide having a particle size of 0.1 to 0.5$\mu$. The coating weight of titanium oxide is preferably from 0.03 to 3 g/m$^2$, more preferably from 0.05 to 2 g/m$^2$.

The mat layer may be formed on the support either directly or through a subbing layer. The subbing layer may be formed from a coating solution of a binder or binders in an organic solvent such as methanol, acetone or methyl ethyl ketone. Suitable binders are cellulose esters such as nitrocellulose and cellulose diacetate; polyesters; or styrene-butadiene copolymers or vinylidene chloride copolymers. The subbing layer may optionally contain a swelling agent for a polyester film such as cresol, p-chlorophenol or resorcin.

The mat layer may be applied directly to the hydrophobic support or to a subbing layer which is coated on the hydrophobic support by any conventional technique such as gravure coating, extrusion coating, dip coating, bar coating or roller-bead coating. The drying temperature preferably ranges from 50° to 140° C., and the drying period preferably ranges from 30 seconds to 10 minutes. The coating weight of the matting agent preferably ranges from 1 to 20 g, more preferably from 3 to 10 g, per square meter. The coating weight of poly(methyl methacrylate) preferably ranges from 1 to 10 g, more preferably from 2 to 5 g, per square meter. The coating weight of the hydrophilic polymer preferably ranges from 0.1 to 8 g, more preferably from 1 to 5 g, per square meter.

The mat film of the present invention can also be used as the support of a wash-off photographic material. The image area (i.e., exposed area) of the photosensitive emulsion layer of the wash-off material hardens upon development whereas the non-image area (unexposed area) remains unhardened. After the development, the non-image area is washed off under flowing water to provide the image area in relief. Therefore, the greatest feature of the wash-off photographic material is that it is developed with a tanning developing agent that hardens only the exposed area. The tanning developing agent may be incorporated either in the photographic material or in the processing solution.

Illustrative tanning developing agents are catechol, 4-phenyl catechol, hydroquinone, pyrogallol, dihydroxybiphenyl and polyhydroxyspirobisindane. For more examples, see U.S. Pat. Nos. 2,592,368, 2,685,510, 3,143,414, 2,751,295 and 3,440,049. If these tanning developing agents are incorporated within the photographic material, their amount preferably ranges from 0.005 to 1 mol, more preferably from 0.01 to 0.3 mol, per mol of the silver halide in the emulsion layer. The developing agents may be added not only to the emulsion layer but also to the adjacent layer.

The tanning developing agents may be incorporated in the photographic material by various methods. One example is to neutralize alkali solutions of these agents as taught in U.S. Pat. No. 3,440,049. Another example is to disperse the agents in water-soluble organic solvents such as cyclohexanone, acetone, methoxyethanol, ethoxyethanol, ethylene glycol, dioxane and dimethylformamide. In still another method, the agents are dispersed in high-boiling point organic solvents for coupler dispersion such as butyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate and trioctadecyl phosphate (see U.S. Pat. No. 3,676,137) or diethyl succinate, dioctyl adipate or 3-ethylbiphenyl. A surfactant may be used to help disperse the solutions of the tanning developing agents in these solvents in hydrophilic protective colloidal solutions, and suitable surfactants are saponin, sodium alkylsulfosuccinate and sodium alkylbenzenesulfonate.

The wash-off photographic material according to the present invention comprises the mat film of the present invention that is coated with a silver halide emulsion layer as the photosensitive emulsion layer. If necessary, the material may also contain an antihalation layer or a surface protective layer. Suitable silver halides are silver chloride, silver chlorobromide, silver bromide, silver iodobromide and silver iodochlorobromide.

Suitable hydrophilic protective colloids are gelatin, carboxymethyl cellulose, polyvinyl alcohol and polyvinyl pyrrolidone. Gelatin is particularly preferred, and suitable gelatins are lime-treated gelatin, acid-treated gelatin and enzyme-treated gelatin, as well as gelatin derivatives.

The silver halide emulsion layer may also contain an anti-foggant, a polymer latex, a surfactant, a chemical sensitizer, a spectral sensitizing dye, etc. For details of these additives, see *Research Disclosure,* 176, pp. 22–29, December, 1978.

The surface protective layer may contain not only the hydrophilic protective colloid but also a mating agent, a surfactant, a polymer latex, colloidal silica, etc.

The wash-off photographic material according to the present invention preferably has an antihalation layer between the support (i.e., mat film) and the photosensitive emulsion layer. The antihalation layer may contain not only the hydrophilic protective colloid but also a light-absorbing material such as carbon black, colloidal silver, or any of the dyes that are listed in *Research Disclosure,* supra. Carbon black or colloidal silver are particularly preferred. For facilitating coating with a hydrophilic colloidal layer such as the silver halide emulsion layer or antihalation layer, the mat layer may be subbed with a layer that is primarily made of gelatin.

The wash-off material according to the present invention may be developed with any known technique. If the tanning developing agent is incorporated in the wash-off material, it may be processed in an activator bath. The basic composition of the activator bath is the same as the conventional black-and-white developing solution except for no developing agent; it may optionally contain a pH buffer, an anti-foggant, a development accelerator and a water softener.

The present invention is described in greater detail by reference to the following examples which are given here for illustrative purposes only and are by no means intended to limit the scope of the invention.

EXAMPLE 1

A biaxially oriented crystalline polyethylene terephthalate film was coated with a solution of the following formulation in an amount of 15 g/m$^2$, and dried at 120° C. for 10 minutes:

| Components | Content (wt %) |
|---|---|
| Nitrocellulose | 0.5 |
| Metacresol | 8.0 |
| Acetone | 42.0 |
| Methanol | 49.5 |

Three samples of the so treated film were coated with the following dispersions of matting agent (a), (b) and (c) in an amount of 40 g/m$^2$, and dried at 120° C. for 5 minutes to provide three mat films (A), (B) and (C).

| Components | Content (wt %) |
|---|---|
| Dispersions of Matting Agent (a) | |
| Poly(methyl methacrylate), "Sumipex B-LG" (product of Sumitomo Chemical Co., Ltd.) | 10 |
| Methyl ethyl ketone | 47 |
| Acetone | 25 |
| Diacetone alcohol | 10 |
| Silicon oxide (av. size = 1.5μ) | 7 |
| Titanium oxide (av. size = 0.3μ) | 1 |
| Dispersion of Matting Agent (b) | |
| Poly(methyl methacrylate), "Sumipex B-LG" (product of Sumitomo Chemical Co., Ltd.) | 8 |
| Nitrocellulose, RS ½ of Daicel Chemical Industries, Ltd. | 3 |
| Methyl ethyl ketone | 46 |
| Acetone | 25 |
| Diacetone alcohol | 10 |
| Silicon oxide (av. size = 1.5μ) | 7 |
| Titanium oxide (av. size = 0.3μ) | 1 |
| Dispersion of Matting Agent (c) | |
| Poly(methyl methacrylate), "Sumipex B-LG" of Sumitomo Chemical Co., Ltd. | 6 |
| Nitrocellulose, RS ½ of Daicel Chemical Industries, Ltd. | 2.5 |
| Methacrylic acid-methyl methacrylate copolymer (MAA to MMA molar ratio = 2:8, m. wt. = ca. 10,000–30,000) | 3.0 |
| Methyl ethyl ketone | 45.5 |
| Acetone | 25.0 |
| Diacetone alcohol | 10.0 |
| Silicon oxide (av. size = 1.5μ) | 7.0 |
| Titanium oxide (av. size = 0.3μ) | 1.0 |

Letters were written into the mat surface of each sample in drawing ink, erased with a rubber eraser and the same letters were written on the erased area. On the second trail of retouching, Samples (A) and (B) repelled the applied ink and gave only very thin lines. Sample (C) withstood 10 retouching operations and produced lines of the desired fineness.

EXAMPLE 2

(1) Preparation of a Support

A biaxially oriented crystalline polyethylene terephthalate film 100μ thick was coated with a solution of the following formulation in an amount of 10 g/m$^2$ and dried at 120° C. for 5 minutes.

| Components | Content (wt %) |
|---|---|
| Cellulose acetate | 0.4 |
| Nitrocellulose | 0.4 |
| Acetone | 50.0 |
| Resorcin | 6.2 |
| Methanol | 43.0 |

The so treated film was coated with the following dispersion of matting agent in an amount of 50 g/m$^2$ and dried at 120° C. for 10 minutes.

| Components | Content (wt %) |
|---|---|
| Poly(methyl methacrylate), "Sumipex B-LG" of Sumitomo Chemical Co., Ltd. | 7 |
| Nitrocellulose, RS ½ of Daicel Chemical Industries, Ltd. | 3 |
| Methyl methacrylate-methacrylic acid (85:15 mol %) copolymer | 4 |

-continued

| Components | Content (wt %) |
|---|---|
| Diacetone alcohol | 15 |
| Acetone | 47.5 |
| Methanol | 11 |
| Silicon oxide (av. size = 1.5μ) | 12 |
| Titanium oxide (av. size = 0.3μ) | 0.5 |

The resulting mat layer was further coated with the following solution in an amount of 10 g/m$^2$ and dried at 120° C. for 10 minutes.

| Components | Content (wt %) |
|---|---|
| Gelatin | 1.0 |
| Polyamide epichlorohydrin resin described in Japanese Patent Publication No. 26580/74 | 0.02 |
| Nitrocellulose | 0.5 |
| Water | 2.0 |
| Acetic acid | 2.0 |
| Methanol | 63.48 |
| Acetone | 30.0 |

(2) Preparation of a Wash-Off Photographic Material

An emulsion containing 60 g of gelatin and 1.1 mols of silver chlorobromide (silver bromide content: 30 mol %) in 760 g of water was prepared. The silver chlorobromide grains had an average size of 0.4 micron. After removing soluble salts by a conventional method, the emulsion was chemically sensitized with sodium thiosulfate. To the so sensitized emulsion, the following composition was added.

| Components | Content (g) |
|---|---|
| 6% Aqueous saponin | 20 |
| Dispersion (a) | 500 |

Dispersion (a) was prepared by vigorously agitating a mixture of the following compositions (a-1) and (a-2).

| Components of (a-1) | Content (g) |
|---|---|
| 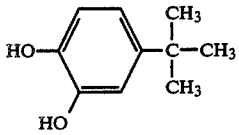 | 17 |
| 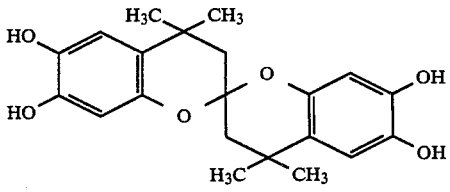 | 3 |

-continued

| | |
|---|---|
| 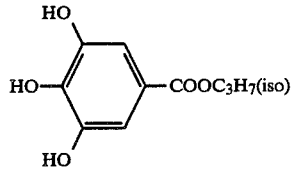 | 7 |
| Tricresyl Phosphate | 18 |
| Ethyl Acetate | 25 |

| Components of (a-2) | Content (g) |
|---|---|
| Gelatin | 25 |
| Water | 380 |
| 6% Aqueous saponin | 25 |

A composition for antihalation layer was prepared from the following formulation.

| Components | Content |
|---|---|
| Gelatin | 40 g |
| Carbon black | 15 g |
| Water | 1,000 ml |

The photographic support prepared in (1) was coated with the composition for antihalation layer to give a carbon black coating weight of 0.1 g/m$^2$. The resulting antihalation layer was overlaid with the silver halide emulsion, thereby forming a wash-off material. The material was exposed through an optical wedge for 5 seconds and developed in an activator bath of the following composition at 20° C. for 10 seconds. The developed material was then immersed in warm water (40° C.) wherein the unhardened area was wiped off with a sponge and thereafter the material was dried.

| Components of the Activator Bath | Content |
|---|---|
| Potassium carbonate | 25 g |
| Potassium hydroxide | 7 g |
| Potassium sulfite | 1 g |
| Potassium bromide | 0.1 g |
| Water to make | 1,000 ml |

The mat surface of the non-image area in relief was subjected to 10 retouching operations with drawing ink; no ink repellency occurred and lines of the desired thickness were produced.

While the invention has been described in detail and with reference to specific embodiments thereof, it will be apparent to one skilled in the art that various changes and modifications can be made therein without departing from the spirit and scope thereof.

What is claimed is:

1. A wash-off photographic material, comprising:

a hydrophobic support having formed thereon:

a mat layer comprising:

a silicon dioxide matting agent; and a binder comprised of a mixture of poly(methyl methacrylate) or a copolymer containing at least 80 wt % of methyl methacrylate and a hydrophilic polymer wherein the mixture includes the hydrophilic polymer in an amount within the range of 80 to 20 wt % based on the total weight of the binder; and wherein the ratio of the matting agent to the polymethyl methacrylate or copolymer containing at least 80 wt % of methyl methacrylate is less than 5:1 or less by weight; and a photosensitive silver halide emulsion layer.

2. A wash-off photographic material as claimed in claim 1, wherein the photosensitive silver halide emulsion layer contains a tanning developing agent.

3. A wash-off photographic material as claimed in claim 1, further comprising:

a tanning developing agent-containing layer adjacent to the photosensitive silver halide emulsion layer.

4. A wash-off photographic material as claimed in claim 1, further comprising:

a carbon black-containing layer positioned between the support and the photosensitive silver halide emulsion layer.

5. A wash-off photographic material as claimed in claim 1, wherein the matting agent has a particle size within the range of 0.5 to 10$\mu$.

* * * * *